United States Patent [19]

Tsukamoto et al.

[11] Patent Number: 4,897,859

[45] Date of Patent: Jan. 30, 1990

[54] APPARATUS FOR IDENTIFYING AND COUNTING LINENS IN BAGS OR BUNDLES

[75] Inventors: Hideo Tsukamoto; Masaru Nishimura; Hidetoshi Ishihara, all of Aichi, Japan

[73] Assignee: Mitsubishi Jukogyo K.K., Tokyo, Japan

[21] Appl. No.: 149,729

[22] Filed: Jan. 29, 1988

[30] Foreign Application Priority Data

Feb. 13, 1987 [JP] Japan ..... 62-31240

[51] Int. Cl.[4] ..... G06M 11/00

[52] U.S. Cl. ..... 377/6; 377/10; 378/44

[58] Field of Search ..... 378/64, 69, 98, 44, 378/57; 250/359.1, 360.1; 377/6, 10

[56] References Cited

U.S. PATENT DOCUMENTS 3,327,942 6/1967 Blume ..... 235/98 C
3,648,054 3/1972 Nance ..... 377/6
4,136,778 1/1979 Wortman et al. ..... 378/44
4,242,583 12/1980 Annis et al. ..... 378/57
4,484,066 11/1984 Debleux et al. ..... 377/6

FOREIGN PATENT DOCUMENTS 48374 1/1983 Japan .
33278 2/1986 Japan .

*Primary Examiner*—John S. Heyman
*Attorney, Agent, or Firm*—Stanger, Michaelson, Reynolds Spivak & Tobia

[57] ABSTRACT

An apparatus for automatic identification and couting of a large number of returned or collected used linens at once by recognizing the shapes of markers that are opaque to X-rays and attached thereto. By numerically processing the shadow images of the markers projected onto an X-ray detector, a many kinds of linens can be identified and counted according to classification instantaneously.

7 Claims, 1 Drawing Sheet

APPARATUS FOR IDENTIFYING AND COUNTING LINENS IN BAGS OR BUNDLES

FIELD OF THE INVENTION AND RELATED ART STATEMENT

The present invention relates to an apparatus for identifying and counting returned linens at the time of collection after use.

It is a common practice for linens suppliers to lease towels, nightwear, sheets and the like to hotels, hospitals, etc. and receive payments for the total of charges accumulated per washing cycle.

At present, it is until several days after each collection that the accurate number of many pieces of linens is determined; tracing pieces lost at leasing institutions (about 3% a year is best on average) is impossible, and linens suppliers are forced to bear the cost.

Therefore, it is desired to count returned linens as they are collected, but no suitable apparatus is currently available.

Previously, a device for counting many kinds of linens by detecting a signal emitted from a transmitter circuit that is attached each piece of linens and powered by a high frequency electromagnetic field generated by an external devices has been known (Japanese Patent Application No. 280515/1985). However, a high frequency field and emitted signal have the tendency of being absorbed by water in wet towels, and each piece of linens has to be separated from the other before counting, obstructing accurate and efficient counting.

Also, Japanese Patent Provisional Publication No. 33278/1986 discloses an apparatus for identifying and counting linens by detecting the size and material of a metal piece attached to each piece of linens with a detector head. If there exist two markers in the detection range (its length: 100–200 mm) of this apparatus at one time, however, the detection becomes impossible. So it is again necessary to separate each piece of linens from the other with suitable intervals before counting.

Furthermore, as an identification apparatus using X-rays, a device for measuring the height of a liquid surface in a container, but this is neither for identifying shapes nor for counting at all.

In addition, an X-ray CT and the like may be used for counting linens if we could disregard their prohibitive cost and a long time for calculation required for identification.

Many different kinds of linens are within the scope of the present invention: face, bath and floor towels; flat and fitting sheets; pillowcases; nightwear and its belts; uniforms; tablecloths; napkins; diaper; etc.

Returned linens are commonly in bags of 20–30 kg or wrapped by a sheet and carried on a 100–150 kg cart. When they are identified and counted, it has been necessary to separate each piece from the other, and an X-ray CT and the like are impractical due to their high cost and long time for calculation.

OBJECT AND SUMMARY OF THE INVENTION

It is an object of the present invention to provide an apparatus for automatic identification and counting of linens as they are returned, i.e., in bags of 20–30 kg with up to 70 different kinds.

To this end the present invention, as a means for solving the above problems, provides an apparatus comprising a means for irradiating X-rays, fanning or through slits, over a conveyor, an X-ray detector for detecting the X-rays passing through linens disposed on said conveyor, and linens such as sheets and towels with X-ray opaque markers of different shapes attached, so that said linens with markers are carried on said conveyor to be identified and counted automatically. Namely, each marker in the linens absorbs X-ray, and said X-ray detector captures the shape of a marker as a shadow. The output from the detector is sent to an image processor. Said image processor then finds the maximum length of a marker and counts the markers by the maximum lengths. The totals of counts are displayed by a display such as a printer.

BRIEF DESCRIPTION OF DRAWINGS

The present invention will now be explained with an embodiment shown in the attached figures.

FIG. 1 is a side view of an apparatus for identifying and counting linens;

FIG. 2 is a sectional view along the line A—A in FIG. 1;

FIG. 3 shows linen with markers; FIGS. 4(*a*), (*b*), (*c*) and

FIG. 5 show examples of the markers in FIG. 3.

DETAILED DESCRIPTION OF THE PREFERRED EMBODIMENT

Figure 1:
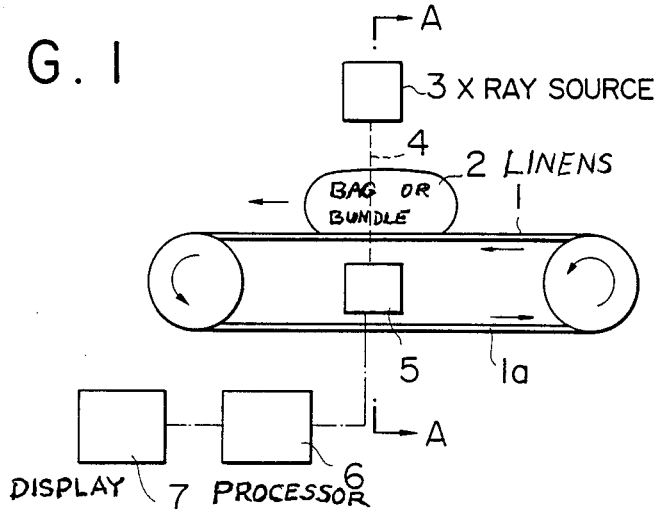
FIGS. 1 to 5 show an embodiment of the present invention.
Figure 3:
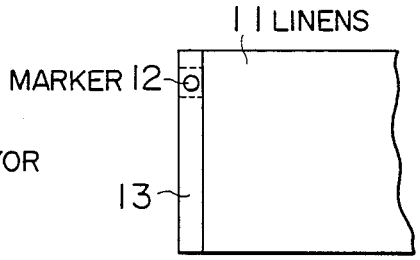

In FIG. 1, a linen conveyor is denoted by 1 and a conveyor belt 1*a* moves in the direction indicated by an arrow. A bag containing linens or a pile of linens is denoted by 2 and a collection of many pieces of linens into which a marker 12 is served at a position shown in FIG. 3: a turned end 13 of a cloth 11. An X-ray source, X-rays, an X-ray detector, an image processor and a display are denoted by 3, 4, 5, 6 and 7, respectively.

Figures 4A, 4B, 4C:
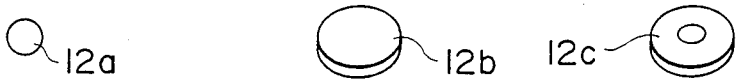

Said marker 12, which is attached to a piece of linen, is made of a rustproof high density material that does not allow X-rays to pass therethrough, such as stainless steel. The shapes of said marker 12, shown merely as examples here, are spherical (FIG. 4(*a*)), having the same size regardless of measuring directions, a circular disk (FIG. 4(*b*)), a doughnut shape (FIG. 4(*c*)), and a rectangular plate (FIG. 5) which has corners distinguishable from any direction. Also, the markers attached to linens 11 have to be small so that they do not cause ill feelings to the users, and the small sizes of said markers make impossible the identification of shadows of these markers with the naked eye. Therefore, marker shadows are identified and counted by an image processor 6. This technique of identifying and counting linens with an image processor has not been known in the state of art.

When said bag or pile of linens 2 on said conveyor 1 pass through the X-rays 4 (fanning or through slits) that are irradiated in the width direction of the conveyor from said X-ray source 3, markers 12 in a linens absorb X-rays, and said X-ray detector captures the shadows of said markers and transmits an output image to said image processor. For said X-ray detector, a combination of an image intensifier with a fluorescing plate and a TV or CCD camera is possible as well as a linear sensor.

Said image processor 6 stores an output image in a memory storage device and processes it numerically for the maximum length of each marker shadow. Said markers are counted according to the calculated maximum lengths and the necessary information thus obtained is displayed by said display 7.

Figure 2:
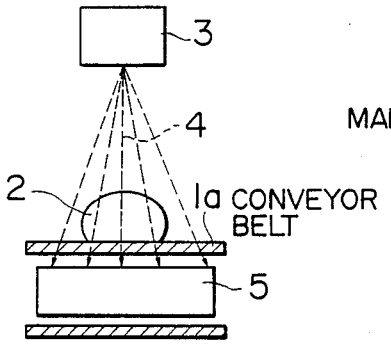

In an experiment, spheres with 0.5, 1, 2 and 3.2 mm diameters and doughnut-shape disks of 6, 10 and 16 mm diameters were used, and their practicality was confirmed. When X-rays 4 are fanning as shown in FIG. 2 the size of a marker shadow entering the detector 5 depends on the vertical position of the marker. The size differences between different markers and the sensitivity of said detector, therefore, have to be selected so that the accuracy of counts is not affected by the differences in the shadow size of the same marker for the above reason. If X-rays are sufficiently parallel a larger number of types and sizes of markers can be used for identification and counting.

As noted above, the markers are very small, but positions at which markers are attached have to be carefully selected because linens to be counted might be worn or used in direct contact with the skin. Generally, linens 11 have triple turns 13 at lengthwise ends to prevent fraying, and said markers 12 can be nicely concealed there.

Figure 5:
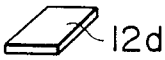

Also, a plate with corners, shown as 12*d* in FIG. 5, may be used as a marker so that identification is done by existence or non-existence of corners in the shadow.

Furthermore, while a case in which linens are stationary on the conveyor is described above, it should be obvious that linens continuously moving on the conveyor can also be identified and counted in the same manner.

When many pieces of linens are counted at once it may be considered a possible source of errors that some marker shadows overlap making identification difficult. However, experiments have confirmed that with sufficiently small sizes of said markers, such as described above, there are no practical problems.

Thanks to the construction of the present invention as described above, the apparatus of the present invention can be used at laundry facilities, on collection trucks or at institutions to which linens are leased. The easy identification and counting of linens afforded by the present invention thus prevent troubles associated with loss of linens and make inventory and quality controls accurate. Furthermore, the apparatus of the present invention can be used for the detection of undesirable objects such as silverware among collected linens.

What is claimed is:

1. A system for identifying and counting linens that comprises:

a plurality of pieces of linens packed in a bag and to which markers of different sizes and/or shapes that are made of materials opaque to X-rays are attached so as to identify the kind of each piece of linens;

an endless conveyor for carrying said linens;

an X-ray source for irradiating fanning X-rays over said conveyor;

X-ray detector means for detecting the X-rays passing through said linens and for capturing the shapes of shadows formed by said markers;

image processor means for finding the maximum length of each of said markers from the output of said detector means and for counting the markers by their maximum lengths; and display means for displaying the total of counts for each maximum length.

2. The system for identifying and counting linens as claimed in claim 1 which is further characterized in that the shapes of said markers include spheres, disks and doughnut-shaped disks whose geometric maximum lengths are independent of the angle from which said markers are viewed.

3. The system for identifying and counting linens as claimed in claim 1 which is further characterized in that the shapes of said markers include rectangular plates.

4. A system for identifying and counting a plurality of linens arranged in a bundle, comprising:

a plurality of markers each attached to one piece of linen in the bundle and having a characteristic identifying the piece of linen to which it is attached;

and endless conveyor for carrying the bundle of linens;

an X-ray source for irradiating X-rays toward the bundle of linens on said conveyor;

X-ray detector means for detecting the X-rays passing through the bundle of the plurality of linens and for capturing the shapes of shadows formed by said markers in the bundle;

image processor means for counting the number of markers of each particular characteristic in the bundle of linens; and display means for displaying the total of counts for each characteristic in the bundle of linens.

5. A system as in claim 4, wherein said characteristics include a maximum length for each of said markers.

6. A system as in claim 5, wherein said markers include spheres, disks, and doughnut-shaped disks.

7. A system as in claim 5, wherein said markers include rectangular plates.

* * * * *